US005806598A

United States Patent [19]

Amani

[11] Patent Number: 5,806,598

[45] Date of Patent: Sep. 15, 1998

[54] APPARATUS AND METHOD FOR REMOVING FLUIDS FROM UNDERGROUND WELLS

[76] Inventor: Mohammad Amani, 2601 Augusta #19, Houston, Tex. 77057

[21] Appl. No.: 692,592

[22] Filed: Aug. 6, 1996

Related U.S. Application Data

[60] Provisional application No. 60/014,850 Apr. 4, 1996.

[51] Int. Cl. [6] ..... F04F 1/06

[52] U.S. Cl. ..... 166/372; 137/155; 137/596.18; 417/143

[58] Field of Search ..... 166/372; 137/155, 137/596.18; 417/143

[56] References Cited

U.S. PATENT DOCUMENTS

| | | | |
|---|---|---|---|
| 1,523,709 | 1/1925 | Pendleton . | |
| 2,254,554 | 9/1941 | Thompson et al. | 103/240 |
| 2,318,029 | 5/1943 | Thompson et al. | 103/231 |
| 2,336,683 | 12/1943 | Hatfield | 417/145 |
| 2,391,542 | 12/1945 | Benard | 417/143 |
| 2,416,359 | 2/1947 | Thompson et al. | 103/231 |
| 2,942,663 | 6/1960 | Haggard | 166/45 |
| 3,022,829 | 2/1962 | Hodges | 166/224 |
| 3,363,692 | 1/1968 | Bishop | 166/42 |
| 3,617,152 | 11/1971 | Cummings | 417/54 |
| 3,894,814 | 7/1975 | Morgan | 417/121 |
| 3,963,377 | 6/1976 | Elliott et al. | 417/90 |
| 4,275,790 | 6/1981 | Abercrombie | 166/314 |
| 4,378,931 | 4/1983 | Adams, Jr. | 251/58 |
| 4,405,291 | 9/1983 | Canalizo | 417/393 |
| 4,427,345 | 1/1984 | Blann et al. | 417/54 |
| 4,429,740 | 2/1984 | Malinchak | 166/53 |
| 4,516,917 | 5/1985 | Canalizo | 417/390 |
| 4,522,370 | 6/1985 | Noack et al. | 251/63.5 |
| 4,766,957 | 8/1988 | McIntyre | 166/265 |
| 4,791,990 | 12/1988 | Amani | 166/311 |
| 4,901,798 | 2/1990 | Amani | 166/311 |
| 4,990,061 | 2/1991 | Fowler et al. | 417/143 |

FOREIGN PATENT DOCUMENTS 0172971 5/1986 European Pat. Off. ..... 43/12

OTHER PUBLICATIONS

Kermit E. Brown, "The Gas Pump, by C.R. Canalizo," The T and C Oil Field Pump, by George L. Thompson, The Technology of Artificial Lift Methods, vol. 2b, pp. 524–532, 540–542.

"Otis Single and Dual–Acting Gas Pumps" Brochure, Otis Engineering Corp., 1982.

Mahmood Amani, "Hydraulic Gas Pump and Gas Well De–Watering System: Two New Artificial–Lift Systems for Oil and Gas Wells", SPE 25422, Mar. 21, 1993.

(List continued on next page.)

*Primary Examiner*—William P. Neuder
*Attorney, Agent, or Firm*—Conley, Rose & Tayon, P.C.

[57] ABSTRACT

An apparatus for supplying and venting gas to a downhole accumulation chamber that includes a supply valve having an open supply position to supply gas to the chamber and a closed supply position, a vent valve having an open vent position to vent gas from the chamber and a closed vent position, and an actuator communicating with a source of pressurized fluid at the surface for actuating the supply and vent valves. The actuator moves the supply valve to the open position and the vent valve to the closed position, and alternately moves the vent valve to the open vent position and the supply valve to the closed supply position. The actuator may include a single hydraulically actuated reciprocating member or a pair of hydraulically actuated reciprocating members. When a pair of reciprocating members is utilized and the apparatus is used in connection with a tubing string having a flowbore, the hydrostatic pressure from the tubing string flowbore may be utilize to provide pressure on one side of each reciprocating member. The apparatus may also include biasing members for biasing each valve to either the open or closed position.

33 Claims, 8 Drawing Sheets

OTHER PUBLICATIONS

Mahmood Amani, "Gas Well De–Watering System and Hydraulic Gas Pump, New Designs and a Discussion on Their Economics," SPE 29163, Nov. 8, 1994.

Mahmood Amani, "Production of Heavy Oil With Hydraulic Gas Pump," Unitar International Conference On Heavy Crude And Tar Sands, Mar. 1995, Houston, Texas.

Mahmood Amani, "Hydraulic Gas Pump: A Discussion of its Power Usage," SPE 029538, Apr. 2, 1995.

M. Amani and H.C. Juvkam–Wold, "Dewatering of Coalbed Methane Wells with Hydraulic Gas Pump," SPE 030982, Sep. 17, 1995.

APPARATUS AND METHOD FOR REMOVING FLUIDS FROM UNDERGROUND WELLS

RELATED APPLICATION

This is a continuing application of provisional application, Ser. No. 60/014,850 filed Apr. 4, 1996 and entitled Hydraulic Gas Pump, which is incorporated herein by reference in its entirety.

BACKGROUND OF THE INVENTION

1. Field of the Invention

The invention relates to a method and apparatus for removing fluids from hydrocarbon producing wells to improve production and, more particularly, to a gas operated pump for pumping fluids from a producing formation to the surface, and still more particularly to an improved valve for a gas operated pump.

2. Background

In the past, various methods and systems for removing fluids from hydrocarbon producing wells to improve production have been suggested. Prior art techniques and devices are discussed in U.S. Pat. No. 4,791,990, which issued on Dec. 20, 1988 to Mahmood Amani; U.S. Pat. No. 4,901,798, which issued on Feb. 20, 1990 to Mahmood Amani; and the 1993 SPE 25422 Paper entitled HYDRAULIC GAS PUMP AND GAS WELL DE-WATERING SYSTEM: TWO NEW ARTIFICIAL-LIFT SYSTEMS FOR OIL AND GAS WELLS by Mahmood Amani, all of which are incorporated herein by reference.

Generally, prior art gas operated pumps operate by injecting pressurized gas into a subsurface chamber to force formation liquids to the surface through a U-shaped tube and venting the gas from the chamber to allow the chamber to refill with liquids. Typically, these pumps include the following additional elements: a first check valve that allows one-way entry of formation liquids into the chamber; flow tubing extending from the chamber to the surface through the well bore; a second check valve to prevent the downward flow of liquid from the flow tubing into the chamber; gas supply tubing for delivering pressurized gas to the chamber; an injection control valve for controlling the input of gas into the chamber; and a vent valve for controlling the venting of gas from the chamber.

U.S. Pat. Nos. 660,545, 3,617,152 and 4,427,345 describe techniques utilizing the forces of pressurized gas and springs to open and close the injection control valve and vent valve. When the gas supply line is pressurized, the force of the gas causes the injection control valve to open and the vent valve to close. As pressure is relieved, the spring force closes the injection control valve and opens the vent valve. Thus, by alternately pressurizing and de-pressurizing the gas supply line, the valves are actuated.

U.S. Pat. No. 4,405,291 describes actuating the injection control valve and vent valve by the upward and downward movement of a piston located within the pump chamber. The piston moves downwardly by the force of the pressurized gas and upwardly by the force of formation liquids filling the pump chamber. In U.S. Pat. No. 4,791,990 to Mahmood Amani (incorporated herein by reference), the injection control valve is actuated by the force of the pressurized gas and the vent valve is opened and closed by a subsurface actuator, which responds to hydraulic pressure transmitted through one or more hydraulic control lines extending from the surface.

These devices and methods have deficiencies for various reasons. First, in many instances, one or both valves are actuated by the pump's pressurized gas, by formation fluids or by springs, none of which can be precisely controlled from the surface. In particular, many prior art devices use the pump's pressurized gas to actuate either or both valves. First, the deeper the well, the greater the quantity of gas which is necessary to overcome the differential pressure in the gas supply line to open the valve. For wells deeper than a few hundred feet, substantial quantities of pressurized gas are needed. Secondly, to close a valve that is opened by the force of pressurized gas, it is necessary to vent or bleed the gas line to release the pressure on the valve. This causes a time lag between the closing of that valve and the opening of the other valve, resulting in slow valve cycling and pump rates. In addition, operating costs are high with the prior art devices and methods because of the significant energy needed to operate the pressurized gas source and the high volume of pressurized gas that is necessary. Further, the reliance on resilient means, such as springs, to open or close the valves opposite differential pressure of the system is ineffective at depths over a few hundred feet because of the magnitude of the differential pressure.

Attempts have been made to overcome these problems by actuating the inlet control valve and vent valve by the reciprocating movement of the flow tubing, such as in U.S. Pat. No. 2,416,359. That device includes flow tubing extending in the wellbore from the surface to the pump chamber that is reciprocated by a hydraulic piston located at the surface. Because the flow tube is usually long and heavy, this method causes structural fatigue and is inefficient and unreliable.

Thus, there exists a need for an efficient and effective gas operated valve for pumping fluids to the surface from an underground well. Accordingly, prior to the development of the present invention, there has been no method of pumping formation fluids to the surface with a gas operated pump having inlet control and vent valves capable of being opened and closed by an independently actuated mechanism that: can be controlled from the surface; provides improved valve cycle rates; does not rely on or use the pump's pressurized gas for valve actuation; does not rely on resilient urging means to overcome system differential pressure; does not require movement of the tubing in the well bore; and operates cost effectively. Therefore, the art has sought a method and apparatus for pumping fluids from a producing hydrocarbon formation utilizing a gas operated pump having valves actuated by an independent hydraulic actuation mechanism to provide increased effectiveness and enhanced efficiency.

The present invention overcomes the deficiencies of the prior art.

SUMMARY OF THE INVENTION

The apparatus of the present invention includes a supply valve having an open supply position to supply gas to a downhole accumulation chamber and a closed supply position, a vent valve having an open vent position to vent gas from the chamber and a closed vent position, and an actuator communicating with a pressurized fluid source at the surface for actuating the valves. The actuator moves the supply valve to the open supply position and the vent valve to the closed vent position, and alternately moves the vent valve to the open vent position and the supply valve to the closed supply position. The actuator may include one or two hydraulically actuated reciprocating members, each reciprocating member having a slidably movable piston disposed within a cylinder. A pair of biasing members for biasing each valve in either the open or closed position, respectively, may be included.

When the apparatus includes a single reciprocating member, each end of the reciprocating member is associated with one of the valves. In operation, hydraulic fluid is alternately injected from the surface into the cylinder above and below the piston, forcing the reciprocating member to reciprocate. When the reciprocating member is moved in one direction, the supply valve is opened and the vent valve is permitted to close, allowing pressurized gas to be inserted from the surface to displace fluids in the accumulation chamber. When the reciprocating member is moved in the opposite direction, the vent valve is opened and the supply valve is closed, allowing gas from the accumulation chamber to be vented through the apparatus.

If the apparatus of the present invention includes a pair of reciprocating members, the terminal end of the first reciprocating member is associated with the supply valve, while the terminal end of the second reciprocating member is associated with the vent valve. In operation, the injection of hydraulic fluid into the cylinder on one side of each reciprocator piston causes the reciprocating members to move in opposite directions. This forces the supply valve to open and permits the vent valve to close, allowing the insertion of pressurized gas into the chamber. The release of hydraulic pressure in the actuator allows the reciprocating members to move back to their original positions, opening the vent valve and permitting the supply valve to close. This allows the venting of the chamber. A conduit may be connected to the actuator opposite the hydraulically pressurized side of the piston of each reciprocating member, providing a constant hydrostatic pressure thereto. This force will encourage movement of the reciprocating members in the second direction as described above. This hydrostatic pressure also allows enhanced control of the operation of the assembly by constantly providing a force opposite the hydraulic force.

The present invention thus provides an improved apparatus and method for use with a gas pump and well tubing for removing fluid from underground wells that does not rely on the use of the pump's pressurized gas for valve actuation. Further, valve actuation with the present invention can be controlled from the surface, improving efficiency and effectiveness.

Other objects, features and advantages of the present invention will be apparent from the drawings, the specifications and the claims.

BRIEF DESCRIPTION OF THE DRAWINGS

For a detailed description of preferred embodiments of the invention, reference will now be made to the accompanying drawings, wherein.

DETAILED DESCRIPTION OF THE PREFERRED EMBODIMENTS

Figure 1:
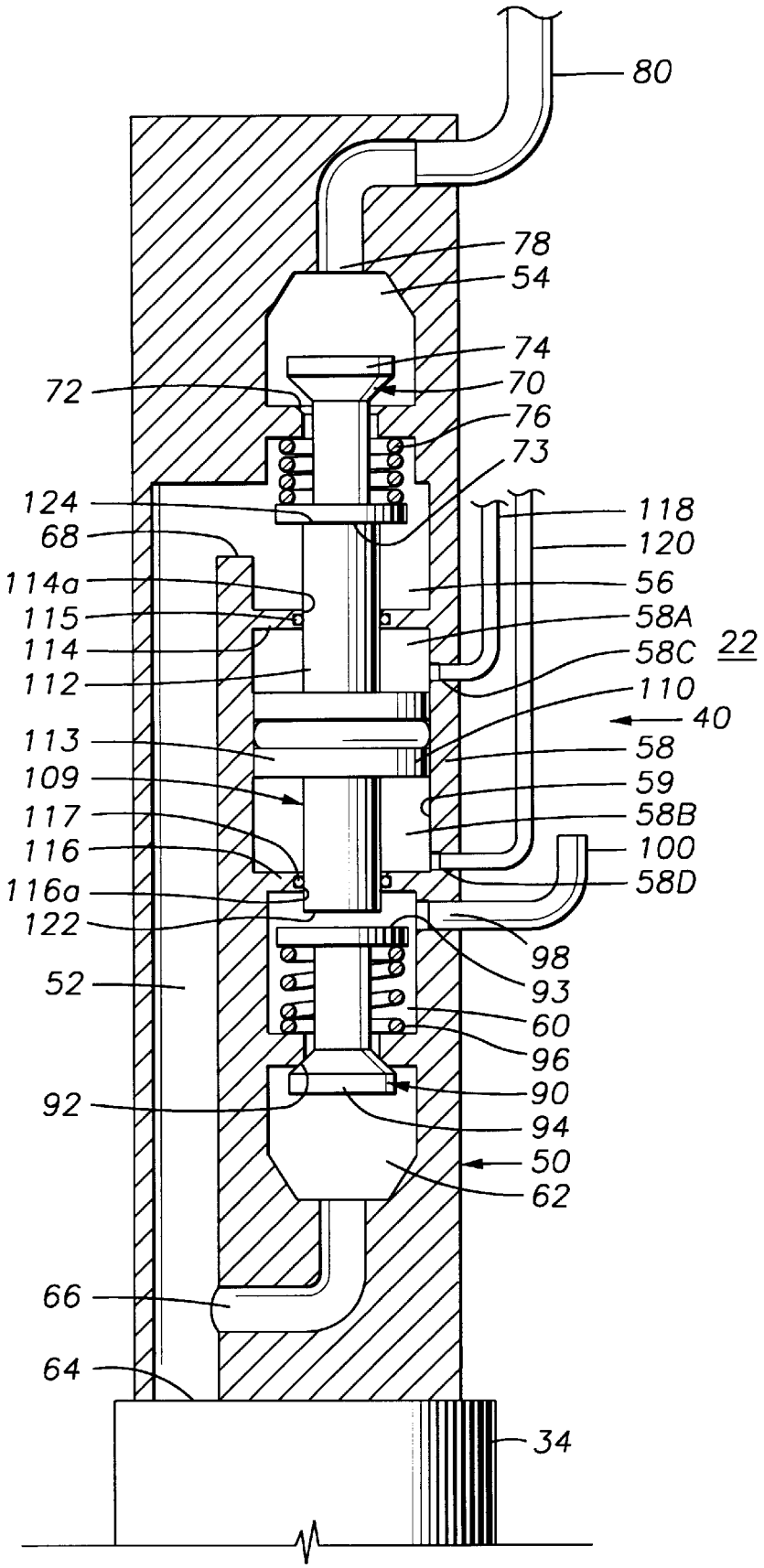
FIG. 1 is a cross-sectional schematic view of a first embodiment of an improved hydraulic valve assembly for a gas operated fluid pump.

In the description which follows, like parts are marked throughout the specification and drawings with the same reference numerals, respectively. The drawings are not necessarily to scale and certain features in certain views of the drawings may be shown exaggerated in scale or in schematic form in the interest of clarity and conciseness.

Figure 2:
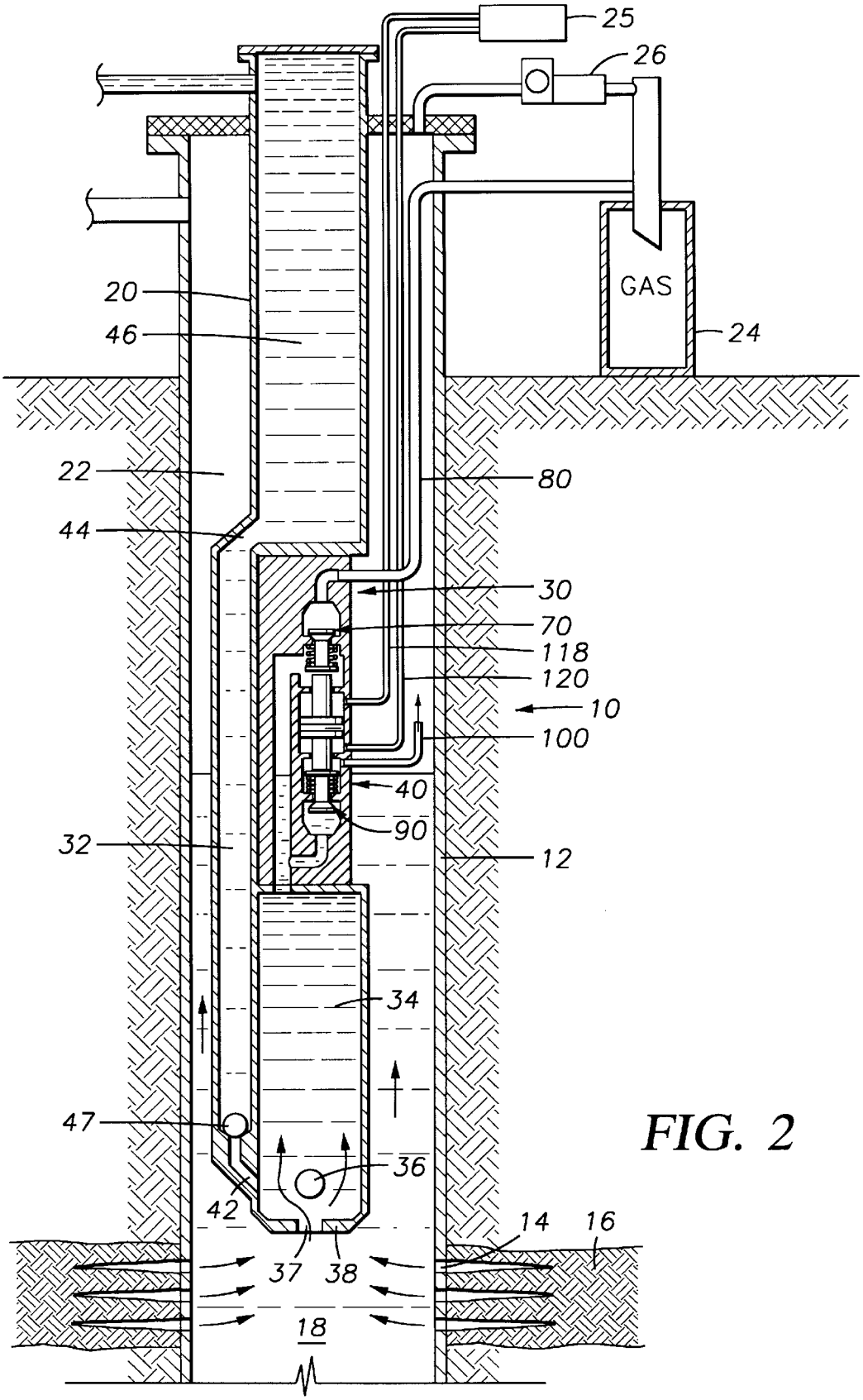
FIG. 2 is an elevational schematic view showing the valve assembly of FIG. 1 as a component of a gas operated pump with the accumulation chamber filled with formation liquids.

Referring initially to FIG. 2, a hydrocarbon producing well 10 is illustrated having a conventional casing 12 with perforations 14, providing fluid communication between the producing formation 16 and the flowbore 18 of casing 12. A tubing string 20 extends from the surface down through the flowbore 18 of casing 12. The hydrocarbons produced by the formation flow to the surface through a flowbore 46 in the tubing string 20.

In the preferred embodiments of FIGS. 2–5, a pressure vessel 24 is used to store and supply high pressure gas. The source for the high pressure gas can be a high pressure gas producing well, or a gas sales line. A compressor 26 compresses the gas from well 10, or from other gas sources, into the high pressure gas vessel 24 to maintain the required pressurized gas volume.

FIG. 2 further illustrates a gas operated pump 30 disposed at the lower end of the tubing string 20. The pump 30 includes an accumulation chamber 34 for the accumulation of formation fluids, a bypass passageway 32, and a valve assembly 40 of the present invention. The accumulation chamber 34 includes a one-way valve such as a check valve 36 at its lower terminal end 38. The one-way valve 36 allows formation fluids to flow into the accumulation chamber 34 through an aperture 37 and prevents the accumulated fluids from flowing back out of accumulation chamber 34 through the aperture 37 in the lower terminal end 38 of the chamber 34.

The bypass passageway 32 extends from an outlet 42 proximate to the lower terminal end 38 of the chamber 34, and extends around the chamber 34 and the valve assembly 40 to an inlet aperture 44 for communicating with the lower end of the flowbore 46 of the tubing string 20. A one-way valve 47 is disposed in the bypass passageway 32 at the lower end thereof to allow flow upwardly through the bypass passageway 32, but closing the passageway 32 to downward flow back into the accumulation chamber 34. Another check valve (not shown) may be added at the inlet 44 to prevent sand or other debris from settling in the bypass passageway 32 when the pump 30 is shut down.

Referring now to the preferred embodiment of FIG. 1, the valve assembly 40 includes a valve housing 50 and a side bore, or flowway, 52. The side bore or flowway 52, shown as an integral part of the housing 50, communicates with the accumulation chamber 34 of the pump 30 via an aperture 64.

The housing 50 includes an inlet chamber 54 for receiving high pressure gas, a first or upper communication chamber 56 in fluid communication with the inlet chamber 54, an enclosure or cylinder 58, an outlet chamber 60 for venting high pressure gas, and a second or lower communication chamber 62 in fluid communication with the outlet chamber 60. The upper and lower communication chambers 56, 62 are each also in fluid communication with the side bore 52. The side bore 52 has an inlet 68 into upper communication chamber 56 and an outlet 66 into lower communication chamber 62.

Pressurized gas is supplied to the inlet chamber 54 of the valve assembly 40 through an inlet port 78 from a gas supply line 80 extending from the pressure gas vessel 24 (FIG. 1). A gas inlet, or injection control, valve 70 is disposed between the inlet chamber 54 and the upper communication chamber 56 to control the inflow of pressurized gas into the flowway 52 for forcing formation fluids from the accumulation chamber 34 into the tubing string 20. The injection control valve 70 is movable between open and closed positions and may be any among a variety of conventional gas valves. In the preferred embodiment of FIG. 1, the valve 70 includes a valve closure member 74 that is sealably enagageable with a valve seat 72, and a surface 73 for engagement with an actuation mechanism 109, as will be described further below. A resilient urging means, such as a spring 76, may be included for biasing the closure member 74 to the closed position in sealing engagement with the valve seat 72.

The valve assembly 40 also includes a gas vent valve 90 disposed between the outlet chamber 60 and the lower communication chamber 62. The vent valve 90 is movable between open and closed positions and may take the same general form as the injection control valve 70. The vent valve 90 shown in FIG. 1 includes a valve closure member 94 that is sealably enagageable with a valve seat 92, and has a surface 93 for engagement with the actuation mechanism 109. A resilient urging means, such as a spring 96, may be included for biasing the closure member 94 to the closed position in sealing engagement with the valve seat 92. The vent valve 90 permits the exhaust or venting of gas from the accumulation chamber 34 and the valve assembly 40 through a vent port 98 in the outlet chamber 60. As show in FIGS. 1 and 2, the vent port 98, communicates with a vent line 100 which extends into an annulus 22 between the tubing string 20 and the casing 12. Alternately, the exhausted gas can be directed into a collection vessel (not shown) from the outlet chamber 60.

The valve assembly 40 also includes an actuator 109 associated with a hydraulic input mechanism for actuating the inlet control valve 70 and the vent valve 90. When connected to a hydraulic source 25 (FIG. 2) located above ground via a hydraulic input mechanism, the actuator 109 and thus the actuation of the valves 70, 90 may be controlled from the surface. Generally, one phase of operation of the actuator 109 causes the input control valve 70 to open and the vent valve 90 to close, while another phase causes the opposite valve movements. The valve assembly 40 can thus be operated with little or no time lag between the opening of one valve and the closing of the other valve to effect efficient pumping of fluid from the accumulation chamber 34.

Still with respect to the preferred embodiment of FIG. 1, a single reciprocating member 110 is disposed within the enclosure, or cylinder, 58. The reciprocating member 110 includes a stem 112 with ends 124, 122 extending through apertures 114*a*, 116*a* in the end walls 114, 116 of the cylinder 58, respectively. Seals 115 and 117 may be mounted, or encased, within apertures 114*a*, 116*a*, respectively, to provide a fluid seal about the stem 112 as it reciprocates therein, as will be described below. The stem 112 extends between the injection control valve 70 and the vent valve 90 whereby the terminal ends 124, 122 of the stem 112 are adapted to engage the engagement surface 73, 93 of valves 70, 90, respectively, to open one or the other of the valves 70, 90 upon reciprocation within the enclosure or cinder 58.

The reciprocating member 110 has a piston 113 that slideably, sealably engages the inner wall 59 of the cylinder 58, effectively dividing the cylinder 58 into first and second sides or cells 58A, 58B. The reciprocating member is driven by hydraulic pressure from a hydraulic input mechanism. In the preferred embodiment of FIGS. 1–5, the hydraulic input mechanism includes input conduits 118, 120 connected with a hydraulic source 25. The first hydraulic input conduit 118 communicates with the first side 58A of the cylinder 58 through a port 58C. The second hydraulic input conduit 120 extends from the hydraulic source 25 to a port 58D in the second side 58B of the cylinder 58.

In operation, upon pressurization through the first hydraulic input conduit 118, the first side 58A is pressurized, forcing the piston 113 and, thus, the reciprocating member 110 to move downwardly within the cylinder 58. The lower terminal end 122 of the stem 112 then engages the engagement surface 93 of the vent valve 90, thereby compressing the second resilient urging means 96 and unseating the closure member 94 from the valve seat 92 to open the vent valve 90. This then allows gas to vent from the lower communication chamber 62 through the outlet chamber 60 and out of the valve assembly 40 via the vent port 98. Gas is thus released into the annulus 22 through the vent line 100, or otherwise directed into a collection vessel as desired.

Alternately, upon pressurization of the second hydraulic input conduit 120, supply side 58B of the enclosure 58 is pressurized, causing the reciprocating member 110 to move upwardly so that the upper terminal end 124 of the stem 112 engages the engagement surface 73 of the closure member 74. Upon compressing the first resilient urging member 76, the closure member 74 unseats from the valve seat 72 and allows gas to flow from gas supply line 80 through the inlet chamber 54 and into upper communication chamber 56. As one valve 70, 90 is opened, the other valve 70, 90 is closed by the force of the resilient urging means 76, 96, respectively, without having to overcome any differential pressure in the system.

Figure 3:
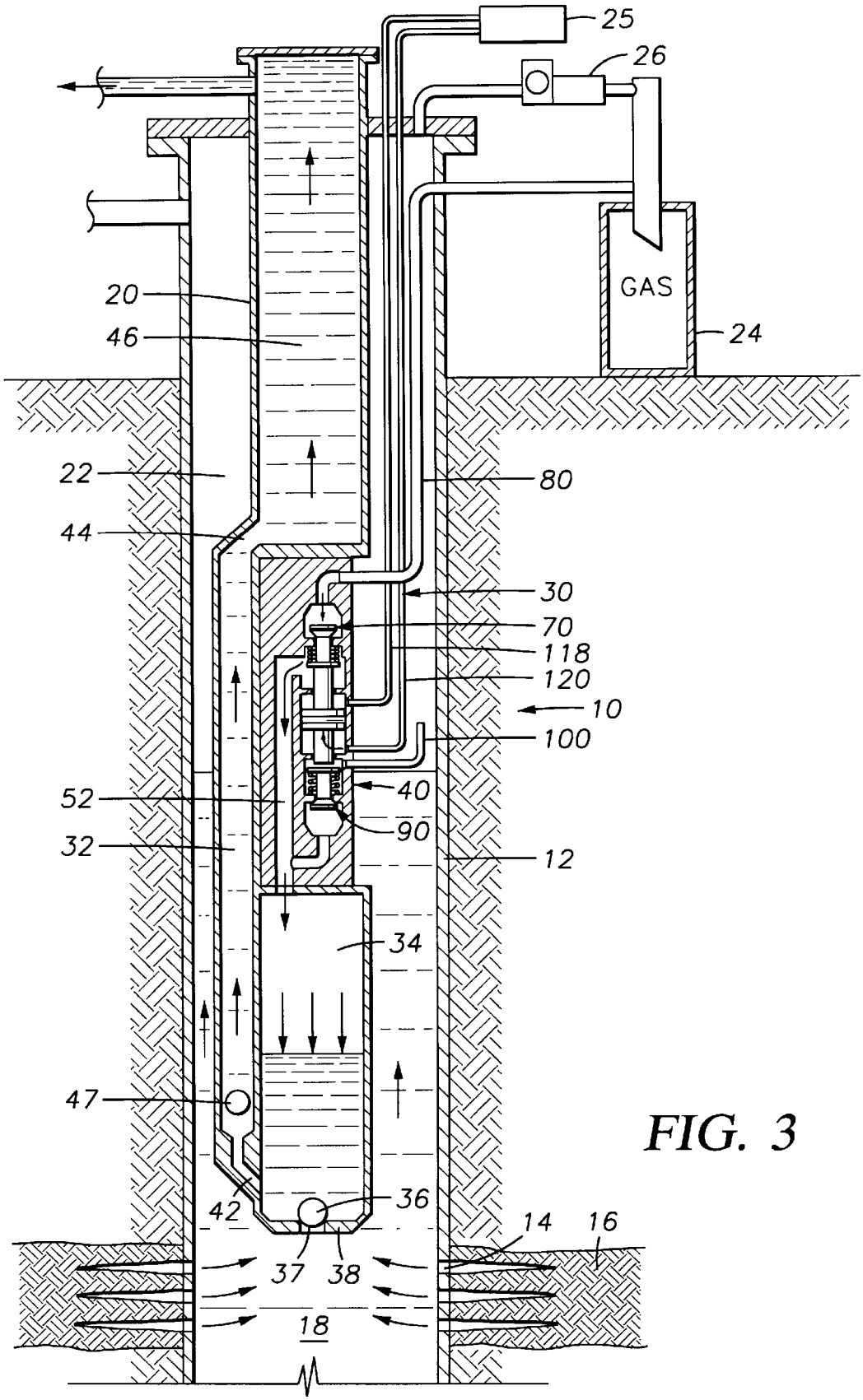
FIG. 3 is an elevational schematic view showing high pressure gas flowing into the gas accumulation chamber, forcing the accumulated formation liquids up the flowbore of a tubing string to the surface.

Referring now to FIGS. 2–5, in operation, formation fluids flow through one-way valve 36 and fill accumulation chamber 34. FIG. 2 illustrates the accumulation chamber 34 filled with formation liquids. The accumulated liquids are pumped from the accumulation chamber 34 by the valve assembly 40 by applying hydraulic pressure through conduit 120 (FIG. 3). As discussed with respect to and shown in FIG. 1, the reciprocating member 110 is thus moved upwardly such that the upper terminal end 124 engages the engagement surface 73 of the injection control valve 70 to open the valve 70. Gas from the supply line 80 and the inlet chamber 54 then passes into upper communication chamber 56, through port 68 and, as shown in FIG. 3, down side bore 52 and into the accumulation chamber 34. The high pressure gas forces the accumulated formation liquids through outlet 42, into bypass passageway 32 and up flowbore 46 of the tubing 20. The accumulated formation liquids cannot pass out of the aperture 37 of the chamber 34 due to the one-way valve 36 closing the lower end 38 of chamber 34 to the formation.

Figure 4:
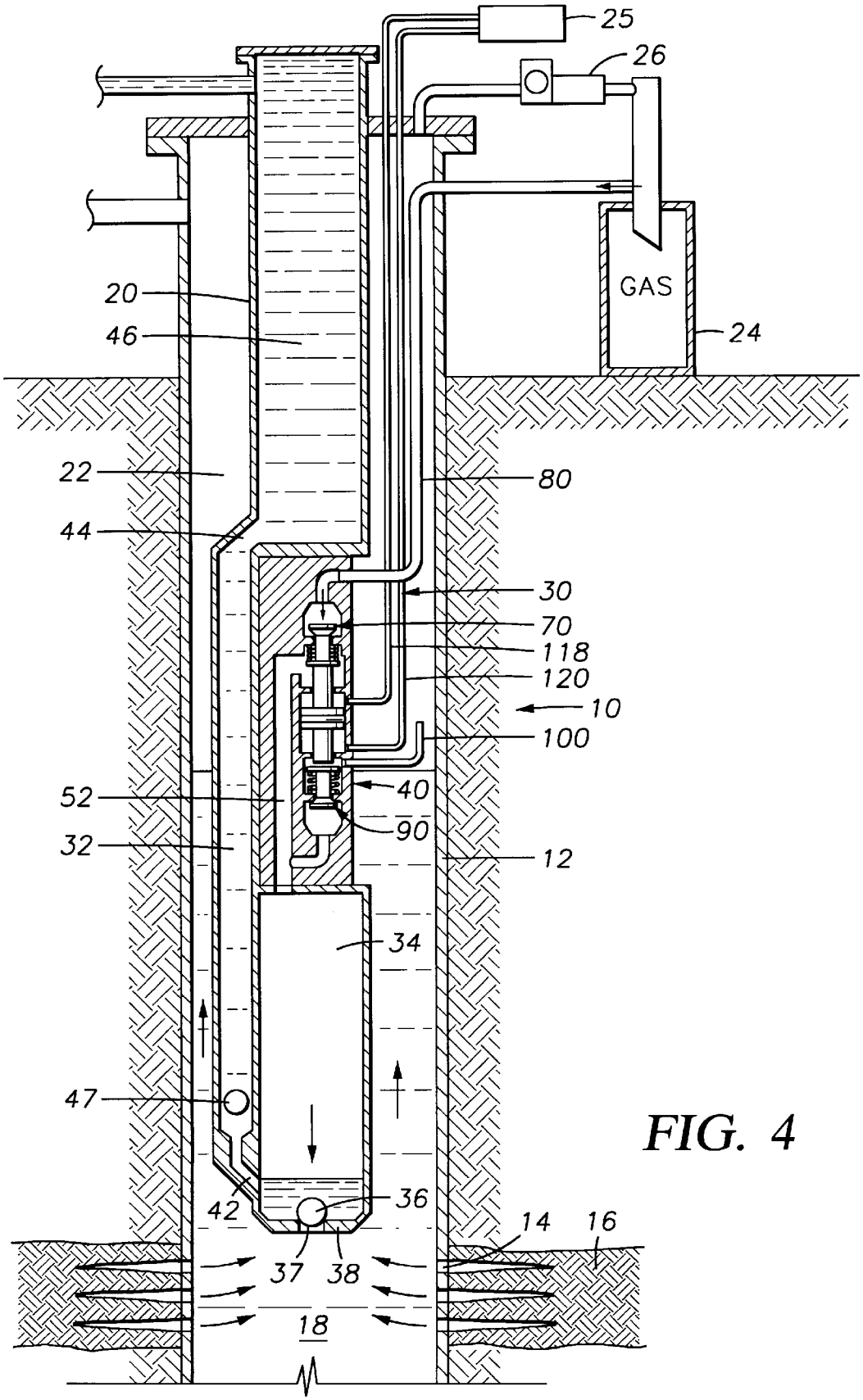
FIG. 4 is elevational schematic view showing the accumulation chamber filled with high pressure gas.
Figure 5:
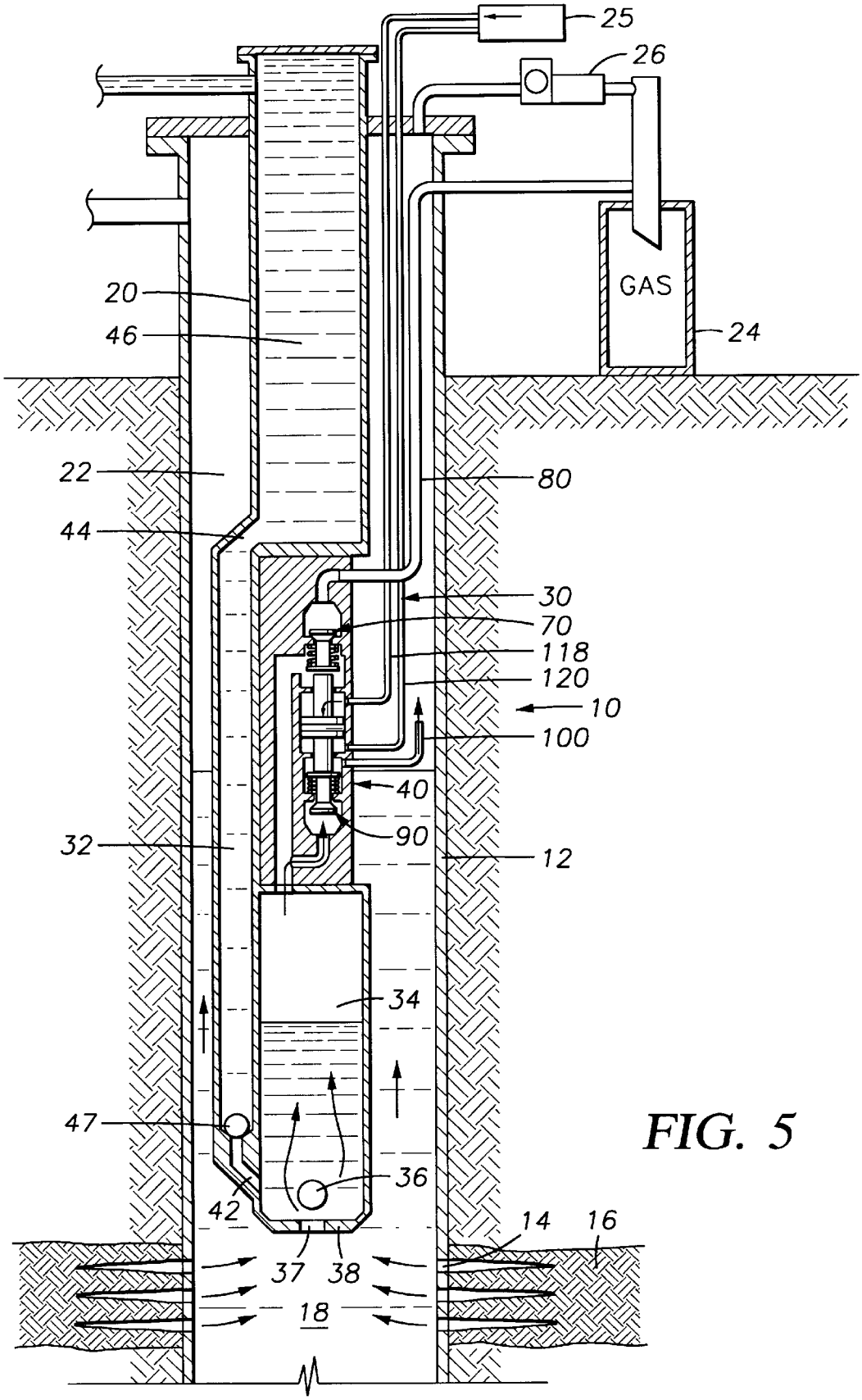
FIG. 5 is an elevational schematic view showing the high pressure gas venting from the accumulation chamber and the accumulation chamber filling with formation liquids.

Referring now to FIGS. 4 and 5, upon filling the accumulation chamber 34 with gas, or otherwise attaining a desired fluid level in the accumulation chamber 34, the hydraulic pressure in the conduit 120 can be reduced and the pressure in the conduit 118 increased, causing the reciprocating member 110 (FIG. 1) to move downwardly to open the vent valve 90 and allow injection control valve 70 to close as previously described. Upon opening the vent valve 90, gas in the accumulation chamber 34 is allowed to vent upwardly through the communication chamber 62 (FIG. 1), the outlet chamber 60 and into the vent line 100 (FIG. 5). As the gas is vented from the accumulation chamber 34, formation liquids are allowed to flow through the one-way valve 36 to again fill the accumulation chamber 34 with formation fluids. Any formation gas that enters the accumulation chamber 34 is pumped out with the pressurized gas. The above procedure is repeated as required to pump formation fluids to the surface.

Figure 6:
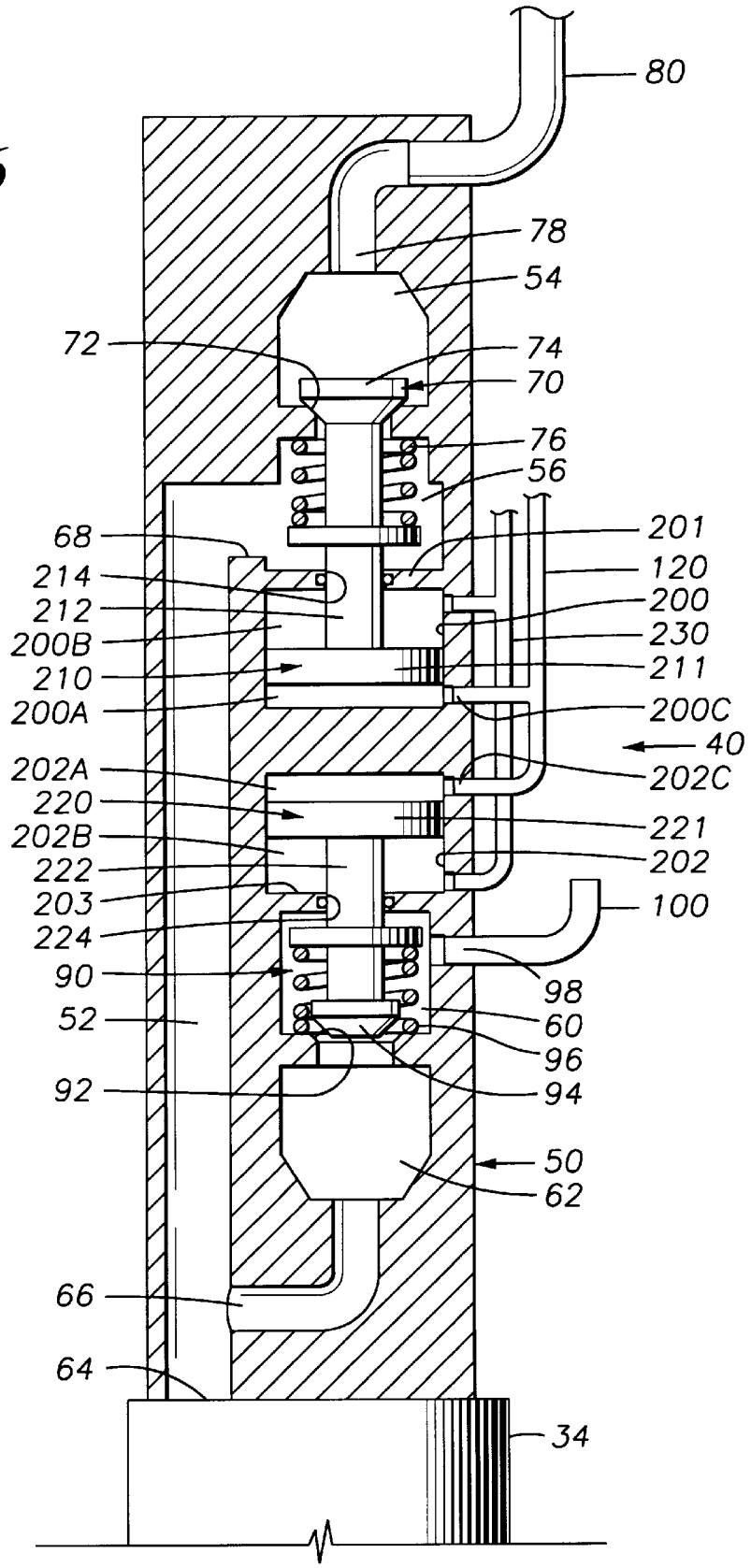
FIG. 6 is a cross-sectional schematic view of a second embodiment of an improved valve assembly for a gas operated pump.
Figure 7:
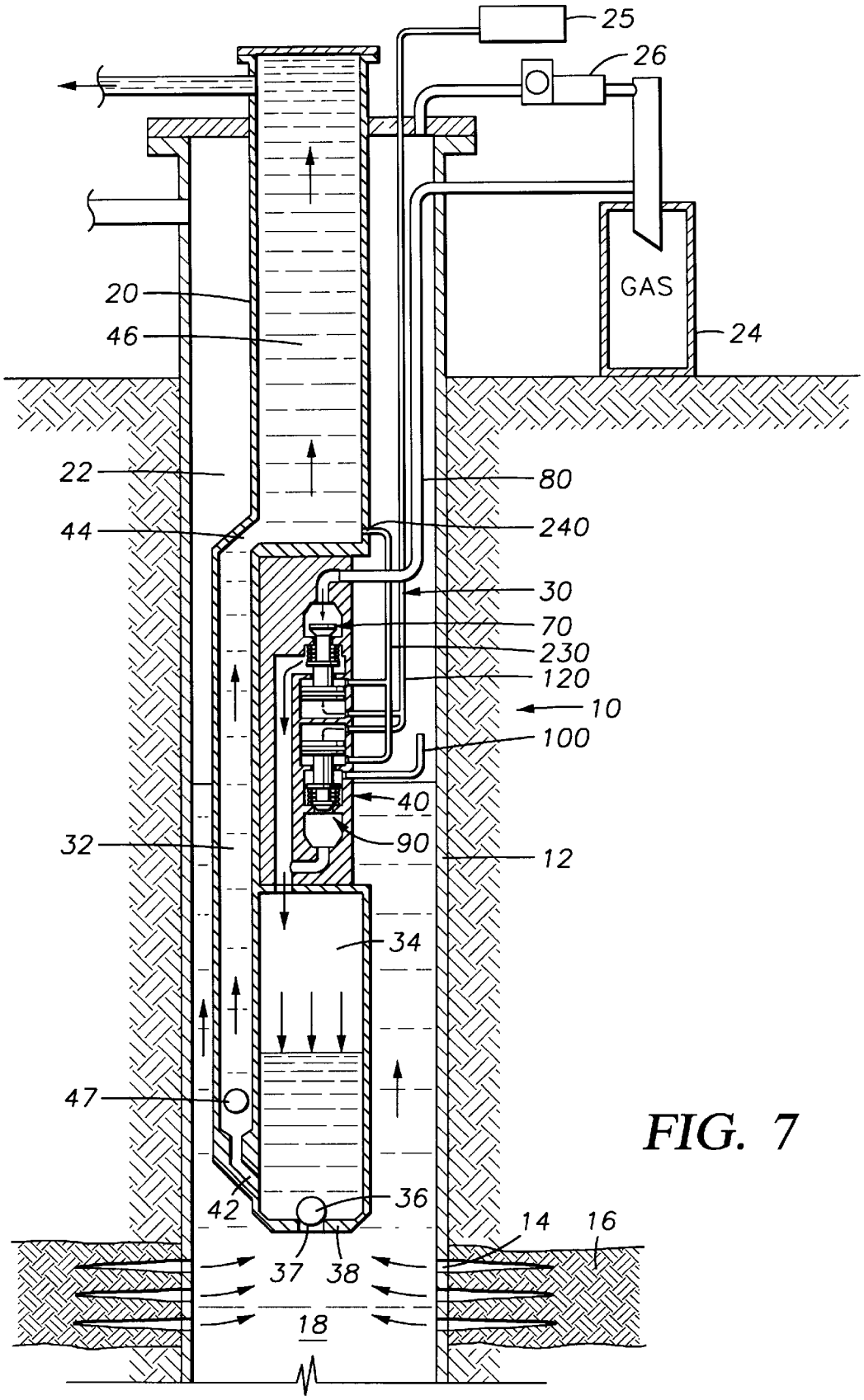
FIG. 7 is an elevational schematic view showing the valve assembly of FIG. 6 in use with a gas operated pump.

Another preferred embodiment of the valve assembly 40 of the present invention for use with a gas operated pump, such as pump 30, is shown in FIGS. 6 and 7. Valve assembly 40 operates as a component of the pump 30 similar to the embodiment of the invention shown in FIGS. 2–5 with respect to the accumulation chamber 34, the bypass passageway 32, the pressurized gas source 24 and the hydraulic pressure source 25, except as noted below. Referring now to FIG. 6, the valve assembly 40 includes a valve housing 50 with a flowway, or side communication passageway, 52. The housing 50 also includes an inlet chamber 54 for receiving high pressure gas, an upper communication chamber 56 communicating with the flowway 52, an upper enclosure or cylinder 200, a lower enclosure or cylinder 202, an outlet chamber 60 for venting gas, and a lower communication chamber 62 also communicating with the flowway 52. The flowway 52 communicates with the upper terminal end of the accumulation chamber 34 at an aperture 64 and includes an outlet 66 into lower communication chamber 62 and an inlet 68 into the upper communication chamber 56.

A first, or injection control, valve 70 is disposed between the inlet chamber 54 and the upper communication chamber 56. Injection control valve 70 includes a valve seat 72, a valve closure member 74, and a resilient urging means, such as a spring 76, for biasing the closure member 74 into the closed position in sealing engagement with the valve seat 72. The inlet chamber 54 includes an inlet port 78 connected to a gas supply line 80, which extends to the surface and is connected to high pressure gas vessel 24 (FIG. 7). High pressure gas vessel 24 supplies high pressure gas through the supply line 80 to the inlet chamber 54, similarly as described with respect to the embodiment of the FIG. 1.

A second, or vent, valve 90 is disposed between the vent chamber 60 and the lower communication chamber 62. The vent valve 90 similarly includes a seat 92, a closure member 94 and a resilient urging means or spring 96. As will be described further below, the spring 96 biases the closure member 94 into the open position. The outlet chamber 60 includes a vent port 98 which communicates with a vent line 100, which may extend into the annulus 22 for venting the gas (FIG. 7).

A first reciprocating member 210 is disposed within the upper cylinder 200. The reciprocating member 210 includes an elongate portion, or actuator stem, 212, which extends through an aperture 214 in an end wall 201 of the upper cylinder 200. The actuator stem 212 is associated with, or connected to, the closure member 74 of the injection control valve 70. Thus, upon upward movement of the reciprocating member 210, the actuator stem 212 moves the valve closure member 74 to its open position.

A second reciprocating member 220 is disposed within the lower cylinder 202. The reciprocating member 220 includes an actuator stem 222, which extends through an aperture 224 in an end wall 203 of the cylinder 202. The actuator stem 222 is associated with, or connected to, the closure member 94 of the vent value 90. Upon downward movement of the reciprocating member 220, the actuator stem 222 moves the closure member 94 into its closed position.

Each reciprocating member 210, 220 has a piston portion 211, 221 that slideably, sealably engages the wall of each respective cylinder, dividing it into two cells. The piston portion 211 divides the first cylinder 200 into a first, or supply cell 200A and a second, or vent, cell 200B. Likewise, the piston 221 divides the cylinder 202 into a first, or supply, cell 202A and a second or vent cell 202B. A hydraulic supply conduit 120 extends from the surface and connects to the first or supply cells 200A, 202A of the cylinders 200, 202 at ports 200C and 202C, respectively.

In operation, upon providing hydraulic pressure through supply conduit 120, the supply cells 200A, 202A are pressurized, causing the second reciprocating member 220 to move downwardly within the cylinder 202 and the first reciprocating member 210 to move upwardly in the cylinder 200. As the second reciprocating member 220 moves downwardly, the actuator stem 222 moves the valve closure member 94 downwardly, compressing the spring 96 and seating the closure member 94 upon the valve seat 92 to close the vent valve 90. This prevents gas from flowing through the valve assembly 40 from the accumulation chamber 34. As the first reciprocating member 210 moves upwardly, the actuator stem 212 moves the closure member 74 upwardly, compressing the spring 76 and unseating the closure member 74 from the valve seat 72. Thus, high pressure gas is permitted to flow from the gas supply line 80 through the inlet chamber 54 and into the upper communication chamber 56. The high pressure gas passes through the inlet 68, down flowway 52 and into the upper end of the accumulation chamber 34, forcing accumulated formation liquids into the bypass passageway 32 (FIG. 7) and up the flow bore 46 of the tubing 20 (FIG. 7).

Upon filling the accumulation chamber 34 with gas, or otherwise attaining a desired fluid level in the accumulation chamber 34, the hydraulic pressure in supply line 120 can be reduced to allow the resilient urging means 76, 96 to expand. This will force the first reciprocating member 210 downwardly, seating the valve closure member 74 upon the valve seat 72, and the second reciprocating member 220 upwardly, unseating the valve closure member 94 from the valve seat 92. To provide greater opening and closing force during this movement, a hydrostatic conduit 230 connecting the vent cells 200B, 202B of each cylinder with the tubing string flowbore 46 (FIG. 7) may be included. In the preferred embodiment of FIGS. 6 and 7, hydrostatic conduit 230 connects the cells 200B, 202B of the cylinders 200 and 202, respectively, with the flowbore 46 of the tubing string 20 at a port 240 in the tubing string 20 above the valve assembly 40. The conduit 230 thus provides fluid communication between the tubing string 20 and the vent cells 200B, 202B, such that the hydrostatic weight of fluid in the flowbore 46 above the valve assembly 40 exerts fluid pressure against the pistons 211 (FIG. 6), 221 opposite the hydraulic pressure in the first cells 200A, 202A. This force on one side of each piston 211, 221 allows enhanced operational control of the valve assembly 20 because the opposing hydraulic force can be controlled from the surface.

As the injection control valve 70 closes, the input of pressurized gas from the supply line 80 is reduced. Upon opening the vent valve 90, gas in the accumulation chamber 34 is allowed to vent upwardly through the communication chamber 62, the outlet chamber 60 and into the vent line 100. As gas is vented from the accumulation chamber 34, formation liquids are allowed to flow through the one-way valve 36 (FIG. 7) to again fill the accumulation chamber 34 with formation liquids. Thus, the valve assembly 40 can be actuated by controlling hydraulic pressure in a single line. The above procedure is repeated as required to pump formation liquids to the surface.

Figure 8:
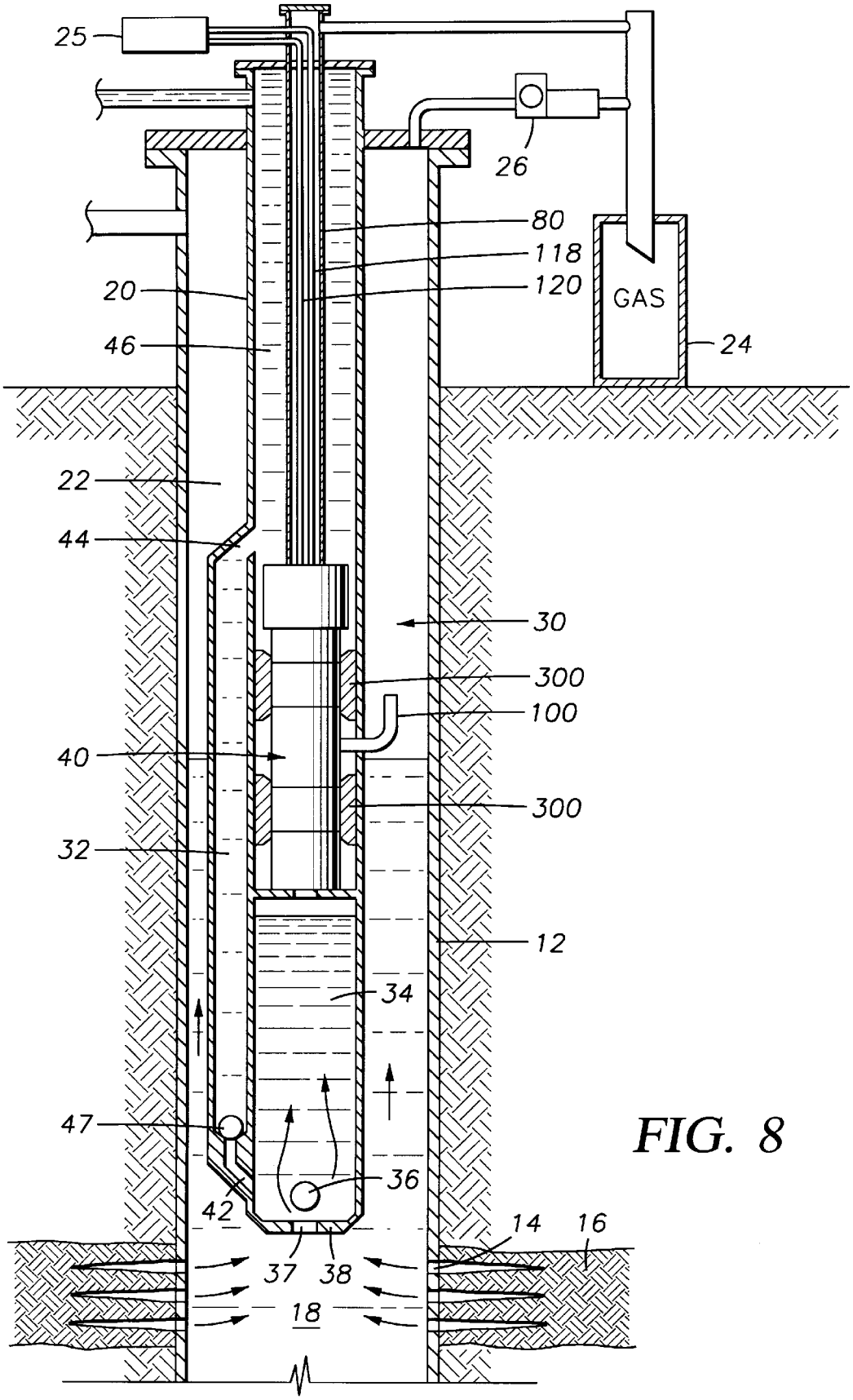
FIG. 8 is an elevational schematic view showing a gas operated pump having an improved valve assembly with a pair of hydraulic input lines concentrically disposed within a gas supply line.

FIG. 8 illustrates the pump 30 and valve assembly 40 having hydraulic input lines 118, 120 concentrically disposed within the gas supply line 80. With this configuration, an improved technique for installation and removal of the valve assembly 40 may be performed. Utilizing this technique, the hydraulic input lines 118 and 120 are concentrically disposed within the supply line 80 at the surface. The supply line 80 may be conventional coiled tubing (not shown) and the hydraulic input lines 118, 120 may be pre-manufactured or pre-installed therein. Also at the surface, the valve assembly 40 is connected to the supply line 80 and the hydraulic input lines 118 and 120.

The valve assembly 40 and the supply line 80 are then lowered into the tubing string 20, such that the supply line 80 is concentrically disposed within the tubing string 20. This double concentric configuration of the hydraulic input lines 118, 120, supply line 80 and tubing string 20 assists in protecting the lines 80, 118, 120 from damage or malfunctioning that may occur when the lines 80, 118, 120 extend within the annulus 22. Further, when coiled tubing is used for the supply line 80 as described above, the valve assembly 40 can be easily installed and removed with conventional coiled tubing techniques.

Thereafter, the valve assembly 40 is connected with the accumulation chamber 34, such as by securing the valve assembly within a conventional seating nipple 300 disposed proximate to the accumulation chamber 34. The seating nipple 300 may be any among a variety of commercially available seating nipples compatible for use with the present invention. This installation technique provides a simplified, time efficient method utilizing existing equipment for installing the valve assembly 40 in the well 10 and for retrieving the valve assembly 40 from the well 10 for maintenance and repairs.

It is to be understood that the invention is not limited to the exact details of construction, operation, exact materials or embodiments shown and described, as obvious modifications and equivalents will be apparent to one skilled in the art without departing from the scope and spirit of the invention a defined by the appended claims. Accordingly, the invention is therefore to be limited only by the scope of the appended claims.

I claim:

1. An apparatus for controlling the flow of gas into and out of a fluid accumulation chamber in an underground well, the apparatus in fluid communication with a gas supply source and an hydraulic fluid supply source, comprising:

a first vale closure member movable between open and closed positions and capable of allowing gas flow into the accumulation chamber from the gas supply source, a second valve closure member movable between open and closed positions and capable of allowing gas flow out of the accumulation chamber, a valve actuator associated with said first and second valve closure members, said valve actuator capable of selectively, opening said first valve closure member and permitting said second valve closure member to close and opening said second valve closure member and permitting said first valve closure member to close, said valve actuator being responsive to fluid pressure from the hydraulic fluid supply source, and at least one hydraulic fluid supply conduit extending into the underground well and capable of allowing the flow of hydraulic fluid from the hydraulic fluid supply source to said valve actuator.

2. The apparatus of claim 1, further including a first resilient urging member capable of biasing said first valve closure member into the closed position and a second resilient urging member capable of biasing said second valve closure member into the closed position.

3. The apparatus of claim 1 further including a housing having a flowway in fluid communication with the accumulation chamber, wherein said first valve closure member is capable of permitting gas flow into said flowway from the gas supply source, and wherein said second valve closure member is capable of permitting gas flow out of said flowway.

4. The apparatus of claim 3 further including two hydraulic fluid supply conduits in fluid communication with said housing.

5. The apparatus of claim 4 wherein said valve actuator includes a reciprocating member slideably retained within said housing and having a first end engageable with said first valve closure member and a second end engageable with said second valve closure member, and wherein hydraulic fluid may be provided into said housing through said first hydraulic fluid supply conduit causing said reciprocating member to open said first valve closure member, and wherein hydraulic fluid may be provided into said housing through said second hydraulic fluid supply conduit causing said reciprocating member to open said second valve closure member.

6. A valve assembly for controlling the flow of gas into and out of a fluid accumulation chamber in an underground well, the valve assembly associated with a gas supply source, comprising:

a housing having a flowway in fluid communication with the accumulation chamber, a first valve closure member disposed within the housing and movable between open and closed positions for permitting gas flow into the flowway from the gas supply source, a second valve closure member disposed within the housing and movable between open and closed positions for permitting gas flow out of the flowway, a reciprocating member slideably retained within the housing and having a first end associated with the first valve closure member and a second end associated with the second valve closure member, and a hydraulic actuator associated with the reciprocating member for providing fluid pressure to the reciprocating member from the surface for alternately moving the reciprocating member in a first direction to cooperatively open the first valve closure member and permit the second valve closure member to close, and moving the reciprocating member in a second direction to cooperatively open the second valve closure member and permit the first valve closure member to close.

7. The valve assembly of claim 6, further comprising a first resilient urging member for biasing the first valve closure member into the closed position, and a second resilient urging member for biasing the second valve closure member into the closed position.

8. The valve assembly of claim 6, wherein the reciprocating member includes first and second ends and a piston disposed between the first and second ends, and further wherein the housing includes first and second ports in fluid communication with the hydraulic actuator for providing fluid pressure in the housing on opposite sides of the piston to alternately drive the reciprocating member in first and second opposing directions.

9. The valve assembly of claim 6, wherein the housing includes first and second communication chambers in fluid communication with the flowway, an inlet chamber in fluid communication with the first communication chamber and associated with the gas supply source, and an outlet chamber in fluid communication with the second communication chamber and having a gas exhaust port, wherein the first valve closure member is disposed between the inlet chamber and the first communication chamber and the second valve closure member is disposed between the second communication chamber and the outlet chamber for controlling the flow of gas into and out of the accumulation chamber.

10. The valve assembly of claim 6, wherein the gas supply source includes a gas input conduit connected with said housing, and wherein said hydraulic actuator includes first and second hydraulic control lines connected with a hydraulic supply source at the surface, and further wherein said first and second hydraulic control lines are concentrically disposed within the gas input conduit.

11. A valve actuation mechanism for use with a valve assembly that controls the flow of gas into and out of a fluid accumulation chamber in an underground well for removing fluids from the accumulation chamber, the valve assembly having a gas inlet valve member and a gas vent valve member, the valve actuation mechanism associated with a hydraulic supply source, comprising:

an enclosure having first and second ends and a wall extending therebetween, the first and second ends each having an aperture extending therethrough, a reciprocating member disposed within the enclosure and including an elongate portion having a first end slideably, sealably moveable through the aperture in the first end of the housing and engageable with the gas inlet valve member and a second end slideably, sealably moveable through the aperture in the second end of the housing and engageable with the gas vent valve member, and a piston disposed between the first and second ends of the elongate portion, the piston slideably, sealably engagable with the wall of the enclosure thereby dividing the enclosure into first and second cells, each of the first and second cells in fluid communication with the hydraulic supply source for fluid pressurization therein, whereby the reciprocating member is reciprocated when the first and second cells are alternately pressurized.

12. A valve assembly for controlling the flow of gas into and out of a fluid accumulation chamber associated with a well tubing located in an underground well, the valve assembly associated with a gas supply source, the well tubing having a flow bore, comprising:

a housing having a flowway therethrough, the flowway in fluid communication with the accumulation chamber, a first valve closure member movable between open and closed positions for permitting gas flow from the gas supply source into the flowway, a second valve closure member movable between open and closed positions for permitting gas flow out of the flowway, first and second reciprocating members slideably retained within the housing, the first reciprocating member associated with the first valve closure member and the second reciprocating member associated with the second valve closure member, and a fluid pressure supply conduit associated with the housing for providing fluid pressure in the housing to cooperatively drive the first reciprocating member in a first direction to open the first valve closure member and drive the second reciprocating member in a first direction to close the second closure member.

13. The valve assembly of claim 12, further comprising a first resilient urging member for biasing the first valve closure member into the closed position and a second resilient urging member for biasing the second valve closure member into the open position.

14. The valve assembly of claim 12, further comprising a hydrostatic conduit extending between the housing and the flow bore of the well tubing to provide fluid pressure in the housing to move the first reciprocating member in a second direction for closing the first valve closure member and to move the second reciprocating member in a second direction for opening the second closure member.

15. A valve actuation mechanism for opening and closing first and second gas valve members of a valve assembly for pumping fluid out of an underground chamber associated with a tubing string having a flow bore, comprising:

a housing having first and second enclosures, each of the first and second enclosures having first and second ends and a wall extending therebetween, the first end of each of the first and second enclosures having an aperture therethrough, a first reciprocating member disposed within the first enclosure and including an elongate portion having a first end slideably, sealably engageable with the aperture in the first end of the first enclosure and associated with the first gas valve member, the first reciprocating member further having a piston slideably, sealably engageable with the wall of the first enclosure thereby dividing the first enclosure into first and second cells, a second reciprocating member disposed within the second enclosure and including an elongate portion having a first end slideably, sealably engageable with the aperture in the first end of the second enclosure and associated with the second gas valve member, the second reciprocating member further having a piston slideably, sealably engageable with the wall of the second enclosure thereby dividing the second enclosure into first and second cells, and a hydraulic conduit associated with the first cell of each of the first and second enclosures for providing fluid pressure therein to cooperatively drive the first reciprocating member in a first direction to open the first gas valve member and drive the second reciprocating member in a first direction to close the second gas valve member.

16. The valve actuation mechanism of claim 15, further comprising a hydrostatic conduit connecting the second cell of each of the first and second enclosures with the flow bore of the tubing string to provide fluid pressure therein for allowing the cooperative movement of the first reciprocating member in a second direction to close the first gas valve member and driving the second reciprocating member in a second direction to open the second valve member as fluid pressure in the hydraulic conduit is reduced.

17. A method for pumping fluid from a fluid accumulation chamber in an underground well to the surface with the use of an apparatus having a gas inlet valve in fluid communication with a gas supply conduit, a gas vent valve, and a valve actuator associated with the gas inlet valve and the gas vent valve, the valve actuator in fluid communication with at least one hydraulic fluid supply conduit extending into the underground well including:

injecting hydraulic fluid into a first hydraulic fluid supply conduit to cause the valve actuator to open the gas inlet valve, and injecting pressurized gas through the gas supply conduit and into the flowway to displace fluids in the accumulation chamber.

18. The method of claim 17 further including injecting hydraulic fluid into a second hydraulic fluid supply conduit to cause the valve actuator to open the gas vent valve and permit the gas inlet valve to close, to allow the flow of gas out of the accumulation chamber.

19. The method of claim 17 further including disposing the gas inlet valve, gas vent valve and valve actuator in a housing, disposing the at least one hydraulic fluid supply conduit at least partially within the gas supply conduit, connecting the hydraulic fluid supply conduit and the gas supply conduit to the housing, and inserting the housing, hydraulic fluid supply conduit and the gas supply conduit into the underground well.

20. The method of claim 17 further including reducing the injection of hydraulic fluid into the first hydraulic fluid supply conduit to allow the gas inlet valve to close and the gas vent valve to open.

21. A method for actuating a gas valve assembly for pumping fluid from a fluid accumulation chamber in an underground well to the surface, the valve assembly having a housing with a flowway in fluid communication with the accumulation chamber, first and second cells in fluid communication with a hydraulic supply source, a gas inlet valve partially disposed in the first cell and in fluid communication with the housing flowway and a gas supply conduit, a gas vent valve partially disposed in the second cell and in fluid communication with the housing flowway and a housing exhaust port, the housing further having first and second resilient urging members for urging the gas inlet valve and gas vent valve into their closed positions respectively, and a reciprocating member partially disposed within the first and second cells and having first and second ends, the first end associated with the gas inlet valve and the second end associated with the gas vent valve, including the steps of:

injecting pressurized hydraulic fluid into the second cell of the housing to drive the reciprocating member in the direction of the gas inlet valve, thereby opening the gas inlet valve and permitting the second resilient urging member to bias the gas vent valve into the closed position, injecting pressurized gas through the gas supply conduit and into the flowway to displace fluids in the accumulation chamber, reducing the injection of pressurized hydraulic fluid into the second cell when the fluid level in the accumulation chamber is reduced to a desired level, reducing the injection of pressurized gas into the gas supply conduit when the fluid level in the accumulation chamber is reduced to a desired level, and injecting pressurized hydraulic fluid into the first cell of the housing to drive the reciprocating member in the direction of the gas vent valve, thereby opening the gas vent valve to allow the flow of gas from the accumulation chamber through the housing exhaust port, and permitting the first resilient urging member to bias the gas inlet valve into the closed position.

22. An apparatus for supplying and venting gas to a downhole accumulation chamber, comprising:

a supply valve having an open supply position to supply gas to the chamber and a closed supply position, a vent valve having an open vent position to vent gas from the chamber and a closed vent position, and an actuator communicating with a source of pressurized hydraulic fluid at the surface for moving said supply valve to the open supply position and said vent valve to the closed vent position, and for moving said vent valve to the open vent position and said supply valve to the closed supply position.

23. The apparatus of claim 22 further including biasing members for biasing said supply valve to either the open supply position or closed supply position and for biasing said vent valve to either the open vent position or closed vent position.

24. The apparatus of claim 23 wherein said actuator includes a hydraulically actuated member for moving said supply valve and vent valve to the other of the positions from the position to which it is biased by said biasing members.

25. The apparatus of claim 22, further comprising a hydraulic supply conduit for connecting said actuator with the pressurized gas source, and a gas supply conduit associated with said supply valve, wherein said hydraulic supply conduit is at least partially disposed within said gas supply conduit.

26. An apparatus for controlling the flow of gas into and out of a fluid accumulation chamber in an underground well, the apparatus in fluid communication with a gas supply source and an hydraulic fluid supply source and associated with a well tubing having a flow bore, comprising:

a first valve closure member movable between open and closed positions and capable of allowing gas flow into the accumulation chamber from the gas supply source, a second valve closure member movable between open and closed positions and capable of allowing gas flow out of the accumulation chamber, a valve actuator associated with said first and second valve closure members, said valve actuator capable of selectively opening said first valve closure member and closing said second valve closure member and allowing said second valve closure member to open and allowing said first valve closure member to close, said valve actuator being responsive to fluid pressure from the hydraulic fluid supply source, and at least one hydraulic fluid supply conduit extending into the underground well and capable of allowing the flow of hydraulic fluid from the hydraulic fluid supply source to said valve actuator.

27. The apparatus of claim 26, further including a first resilient urging member capable of biasing said first valve closure member into the closed position and a second resilient urging member capable of biasing said second valve closure member into the open position.

28. The apparatus of claim 26 further including a housing having a flowway in fluid communication with the accumulation chamber, wherein said first valve closure member is capable of permitting gas flow into said flowway from the gas supply source, and wherein said second valve closure member is capable of permitting gas flow out of said flowway.

29. The apparatus of claim 28 wherein said valve actuator includes first and second reciprocating members slideably retained within said housing, said first reciprocating member associated with said first valve closure member and said second reciprocating member associated with said second valve closure member, wherein fluid pressure may be provided through said hydraulic fluid supply conduit into said housing to drive said first reciprocating member in a first direction to open said first valve closure member and drive said second reciprocating member in a first direction to close said second valve closure member.

30. The apparatus claim 28 further comprising a hydrostatic conduit extending between said housing and the flow bore of the well tubing, said hydrostatic conduit capable of providing fluid pressure in said housing to assist in moving said first reciprocating member in a second direction for closing said first valve closure member and moving said second reciprocating member in a second direction for opening said second valve closure member.

31. A system capable of pumping fluid from an underground well to the surface, the system associated with a pressurized gas source and an hydraulic fluid supply source, comprising;

a fluid accumulation chamber having at least one inlet port, a first check valve associated with said inlet port and capable of allowing fluids to enter said inlet port from the underground well and substantially preventing fluid flow from said fluid accumulation chamber into the underground well, a flow tubing extending from said fluid accumulation chamber to the surface, a second check valve associated with said flow tubing and capable of substantially preventing the flow of fluid from said flow tubing into said fluid accumulation chamber, a gas supply conduit capable of delivering pressurized gas to said fluid accumulation chamber from the pressurized gas source, a first control valve capable of allowing the admission of pressurized gas into said fluid accumulation chamber from said gas supply conduit, a second control valve capable of allowing the venting of pressurized gas from said fluid accumulation chamber, a subsurface control valve actuator capable of opening said first and second control valves, and at least one hydraulic fluid conduit extending into the underground well to said subsurface control valve actuator for transmitting hydraulic fluid to said subsurface control valve actuator from the hydraulic fluid supply source.

32. The system of claim 31 further including a pressurized gas compressor associated with said gas supply conduit.

33. The system of claim 32 further including a pressure vessel associated with said pressurized gas compressor and capable of storing pressurized gas.

* * * * *